US009315368B2

(12) United States Patent
Arivett

(10) Patent No.: US 9,315,368 B2
(45) Date of Patent: Apr. 19, 2016

(54) DEVICE AND METHOD FOR REMOVING A POOL OR DECK COVER ANCHOR

(71) Applicant: Vernon Eugene Arivett, Verona, MO (US)

(72) Inventor: Vernon Eugene Arivett, Verona, MO (US)

( * ) Notice: Subject to any disclaimer, the term of this patent is extended or adjusted under 35 U.S.C. 154(b) by 97 days.

(21) Appl. No.: 14/201,653

(22) Filed: Mar. 7, 2014

(65) Prior Publication Data

US 2014/0250655 A1 Sep. 11, 2014

Related U.S. Application Data

(60) Provisional application No. 61/774,393, filed on Mar. 7, 2013.

(51) Int. Cl.
*B66F 15/00* (2006.01)
*B25B 27/02* (2006.01)
*B25B 31/00* (2006.01)

(52) U.S. Cl.
CPC ..... *B66F 15/00* (2013.01); *B25B 27/02* (2013.01); *B25B 31/00* (2013.01); *Y10T 29/4973* (2015.01); *Y10T 29/49821* (2015.01); *Y10T 29/53896* (2015.01)

(58) Field of Classification Search
CPC ..... E04H 17/265; E02D 9/02; E01F 9/011
See application file for complete search history.

(56) References Cited

U.S. PATENT DOCUMENTS

| | | | | |
|---|---|---|---|---|
| 6,527,250 | B1 * | 3/2003 | Tyson | E04H 17/265 254/30 |
| 6,964,407 | B1 * | 11/2005 | Butler | B66F 19/005 254/131 |
| 7,431,266 | B1 * | 10/2008 | Evans | E04H 17/265 254/30 |
| 8,413,959 | B2 * | 4/2013 | Bloswick | E04H 17/265 254/120 |
| 2014/0117295 | A1 * | 5/2014 | Shaw | E04H 17/265 254/30 |
| 2014/0250655 | A1 * | 9/2014 | Arivett | B66F 15/00 29/402.08 |

* cited by examiner

*Primary Examiner* — Lee D Wilson
(74) *Attorney, Agent, or Firm* — Larry E. Severin

(57) ABSTRACT

A device for removing a pool or deck cover anchor includes a base having a front, a rear, and two sides; a swivel rotatably attached to the front of the base with dowel pins so that the swivel will rotate to stay level; a U-shaped gripping element on the swivel, adapted to grip the anchor; a handle attached to the rear of the base, the handle being substantially longer than the swivel; a handle stop on the handle; and wheels rotatably attached to the sides of the base; wherein the handle, base, and swivel form a lever and the wheels allow the tool to roll so that a generally downward force on the handle produces a straight vertical force on the anchor that lifts the anchor out of the ground. Methods for removing and replacing anchors utilize the tool as further described.

12 Claims, 11 Drawing Sheets

DEVICE AND METHOD FOR REMOVING A POOL OR DECK COVER ANCHOR

RELATED APPLICATIONS

This application claims the benefit of the filing date of U.S. Patent Application No. 61/774,393, filed Mar. 7, 2013, which is incorporated herein by reference in its entirety.

BACKGROUND OF THE INVENTION

The present invention relates to a device for removing a pool or deck cover anchor, and more particularly, to a manually operated device that receives the anchor and utilizes leverage to remove the anchor straight out of the ground.

Homes and other occupied establishments may have a pool or deck area, where "anchors" are permanently fixed into a concrete deck or sidewalk. The anchors may retain the ends of ropes, such as nylon cord or line, which attach to the corners or sides of pool covers, deck covers, tents, awnings, shades, or other covers that need to be anchored. For example, a home or hotel may have plastic or metal anchor inserts in drilled holes at spaced intervals around a concrete pool, and the inserts may hold down a pool cover during the winter or a shade during the summer.

Anchors may include a brass anchor screw that is either permanently or removably sunk into the concrete sidewalk around a pool or deck. Some anchors are permanently fixed into the ground, and some anchors are intended to be removable, but can no longer be easily removed due to weathering and deterioration of the sidewalk, the anchor, or both.

The pool or deck anchors become damaged and need to be pulled out and replaced with new ones. Currently, to remove the anchors, people have to physically pull the anchors out of the ground or concrete. This may be an arduous and time consuming task, and if not properly done may damage the surrounding concrete, wood, or other ground. Further, during the removal of the anchors, the anchor hole may become larger and a new anchor cannot be placed back in the same hole. If hammers are used to pry the anchors out, the concrete around the anchor may crumble and break.

As can be seen, there is a need for a device that removes pool or deck cover anchors.

SUMMARY OF THE INVENTION

In one aspect of the present invention, a device for use with an anchor set in the ground, the device includes a base having a front and a rear; a swivel rotatably attached to the front of the base, the swivel having a gripping element adapted to grip the anchor; and a handle attached to the rear of the base; wherein the handle, base, and swivel form a lever so that a generally downward force on the handle produces a straight vertical force on the anchor that lifts the anchor out of the ground.

In another aspect of the present invention, a deck or pool cover anchor removal tool includes a base having a front, a rear, and two sides; a swivel rotatably attached to the front of the base with dowel pins so that the swivel will rotate to stay level; a U-shaped gripping element on the swivel, adapted to grip the anchor; a handle attached to the rear of the base, the handle being substantially longer than the swivel; a handle stop on the handle; and wheels rotatably attached to the sides of the base; wherein the handle, base, and swivel form a lever and the wheels allow the tool to roll so that a generally downward force on the handle produces a straight vertical force on the anchor that lifts the anchor out of the ground.

In yet another aspect of the present invention, a method utilizing a pool or deck cover anchor includes providing an anchor removal tool that includes a base, a swivel on a front of the base with a U-shaped gripping element, and a handle on a rear of the base, the base, swivel, and handle forming a lever adapted to lift the anchor out of the ground; providing a tap handle, a threaded tap, a tapping block having an alignment hole, and a pry bolt having threads that correspond with threads of the tap; placing the tapping block over the anchor so that the alignment hole aligns with the anchor; using the tap handle to run the tap through the alignment hole, thereby creating a threaded hole in the top of the anchor; removing the tap; screwing the pry bolt into the threaded hole in the top of the anchor; and utilizing the anchor removal tool to lift the pry bolt, thereby removing the anchor.

DETAILED DESCRIPTION

Figure 1:
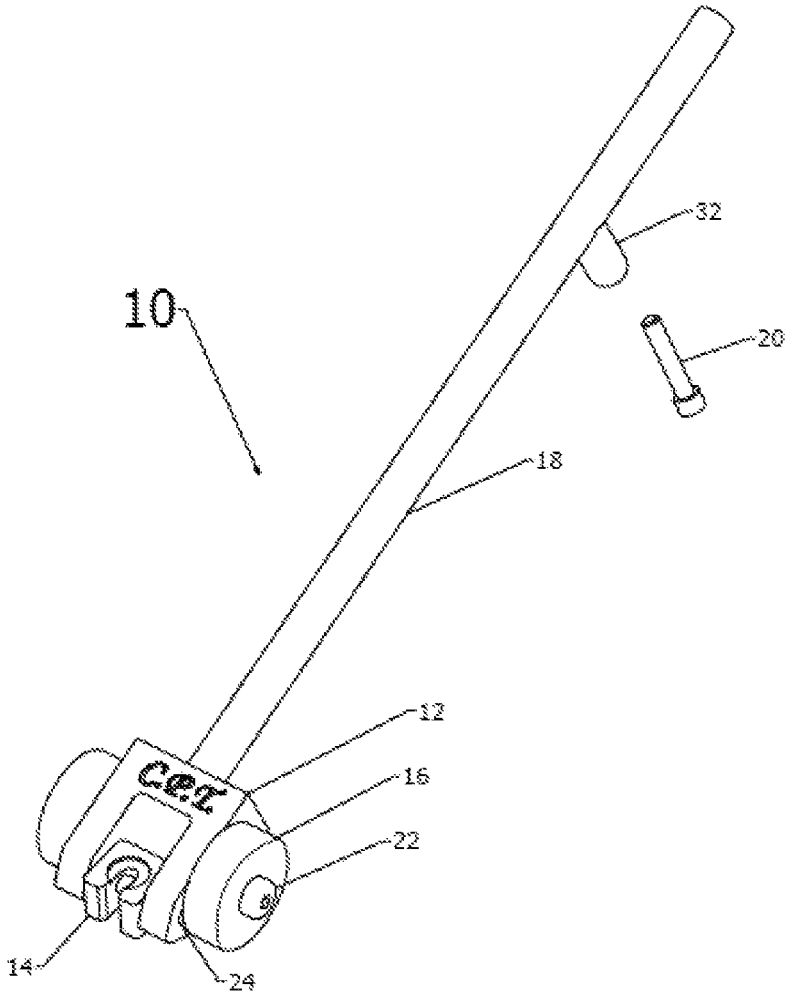
FIG. 1 is a perspective view of an embodiment of a pool or deck cover anchor removal device.

The preferred embodiment and other embodiments, which can be used in industry and include the best mode now known of carrying out the invention, are hereby described in detail with reference to the drawings. Further embodiments, features and advantages will become apparent from the ensuing description, or may be learned without undue experimentation. The figures are not necessarily drawn to scale, except where otherwise indicated. The following description of embodiments, even if phrased in terms of "the invention" or what the embodiment "is," is not to be taken in a limiting sense, but describes the manner and process of making and using the invention. The coverage of this patent will be described in the claims. The order in which steps are listed in the claims does not necessarily indicate that the steps must be performed in that order.

An embodiment of the present invention generally provides a device for removing a pool or deck cover anchor. An embodiment includes a tool with a swiveled lifting element, a handle and 2 wheels, which can be used to remove the anchor. Other embodiments include a tap handle, a threaded tap (a threaded bit), and threaded pry bolt, which are utilized with the device to remove the anchor. Yet further embodiments include a new anchor to replace the removed anchor.

Embodiments of the present invention may provide an anchor removal device comprising: a base having a front end and a rear end; a U-shaped swivel configured to receive an anchor, and rotatably attached to the front end of the base; and a handle attached to the rear end of the base.

The present invention may include an anchor removal tool. The anchor may be a pool cover anchor, a deck anchor or the like. The anchor to be removed may typically be a simple attachment mechanism fixed into a small hole, possibly one of many in the solid walkway around the outside of a pool or deck, so that lines (such as nylon cord) from the cover may reach down to and removably engage with the anchor, thereby helping hold the cover in place. One end of the cord is attached to the cover, and the other end may have an attachment mechanism to engage with the anchor (e.g. the cord has a peg at the end with a compressible flange, which slides into the anchor and engages with a slot in the anchor hole to hold the cord until the peg is pulled out). A plurality of anchors may be positioned around the edges of a pool or around a deck, in order to hold the ends of cords that hold a cover for the pool or deck. The walkway may be poured concrete, carpentered wood, or other solid material around a deck, pool, or other area having embedded anchors or anchor points that need to be removed. Other embodiments of anchors may include an attachment point in a solid floor or ground that engages with the ends of a cord or line to be anchored, e.g. anything having a line that reaches down to the ground and helps retain the thing.

The present invention may remove the anchors easily and without excess effort. An embodiment of the device uses mechanical leverage and pulls the anchor straight up, and thereby may be very easy to use. The present invention may include a swivel, a base, and a handle. The components may be made of aluminum or any other appropriate metal. The base may include a wheel on each side. The wheels may be made of metal, or polymer, such as nylon. An anchor to be removed may be initially fixed into the ground. The anchor may be a permanent anchor, or for some reason a removable anchor may not be able to be easily unscrewed or removed.

As depicted in FIGS. 1-5, an embodiment of an anchor removal tool 10 may include a base 12, a handle 18 attached to the rear of the base 12, and a swivel 14 connected to the front of the base 12. Embodiments may include wheels, such as two nylon wheels 16 attached to each side of base 12 with shoulder bolts 22. The swivel 14 may be connected via dowel pins 24, which may include ⅜ inch dowels. Swivel 14 may include a U-shaped gripping element and may be shaped to receive the anchor and rotate around the dowels so as to keep the top of the swivel level. Embodiments may include a handle stop 32 that separates the handle from the ground, thereby allowing the user to more easily grip the handle. The handle stop may be welded or screwed into the handle, or may be an integrated part of a solid-piece handle-with-stop for the removal tool. Handle stop 32 may be a tube with a socket head cap screw 20, such as a ¼-20 socket head cap screw (i.e. the cap includes a socket), that passes through the bore of the tube and removably screws the stop to the handle. The head of the screw may provide the outer end of the stop, which stops downward movement of the handle when the head rests upon the ground, thereby helping prevent damage to the handle and making the end of the handle easier to grasp by the user. The handle is substantially longer than the swivel, thereby providing a substantial mechanical leverage. In an embodiment, the handle extends at least 3 feet from the base and the swivel gripping element extends no more than 6 inches from the base. An upper surface of the base may include a label, which may identify or promote the makers of the device and which may indicate the top side of the device.

Figure 2:
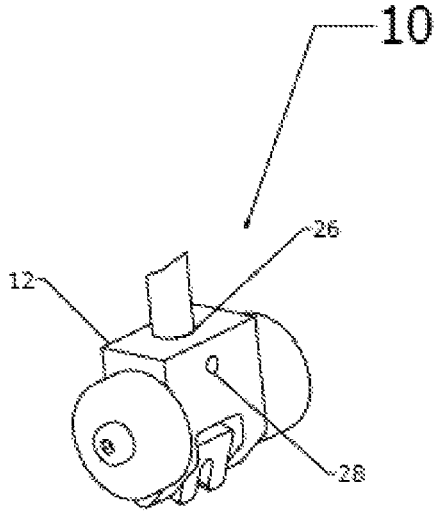
FIG. 2 is a rear view of the embodiment of FIG. 1.
Figure 3:
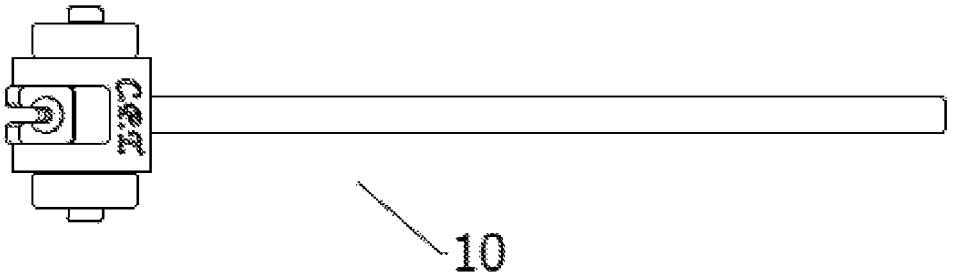
FIG. 3 is a top view of the embodiment of FIG. 1.
Figure 4:
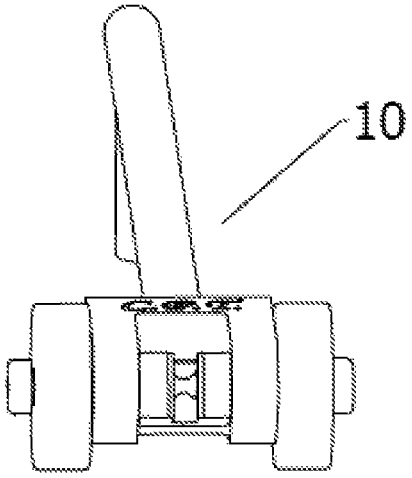
FIG. 4 is a front view of the embodiment of FIG. 1.
Figure 5:
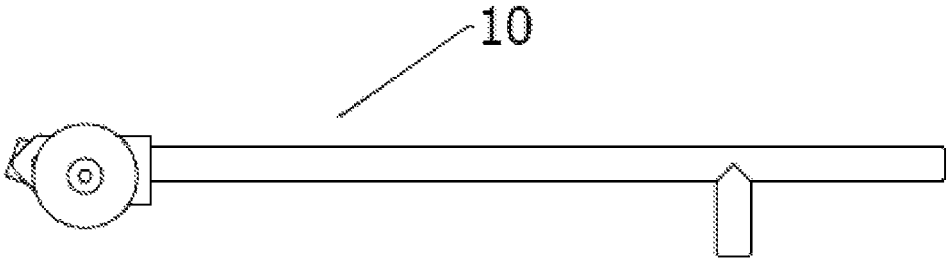
FIG. 5 is a side view of the embodiment of FIG. 1.

As depicted in FIG. 2, an embodiment of an anchor removal tool 10 may include a base 12 with a handle receiving cavity 26. The bottom end of a handle may be inserted into receiving cavity 26 of base 12, and the handle 18 may be releasably locked to the base 12 using screws 28. Example screws 28 for a pool or deck anchor may include ½-13 set screws (i.e. ½" basic major diameter, 13 threads per inch, no cap). The handle may thus be removed from the base for storage and then reinstalled for use.

Figure 6:
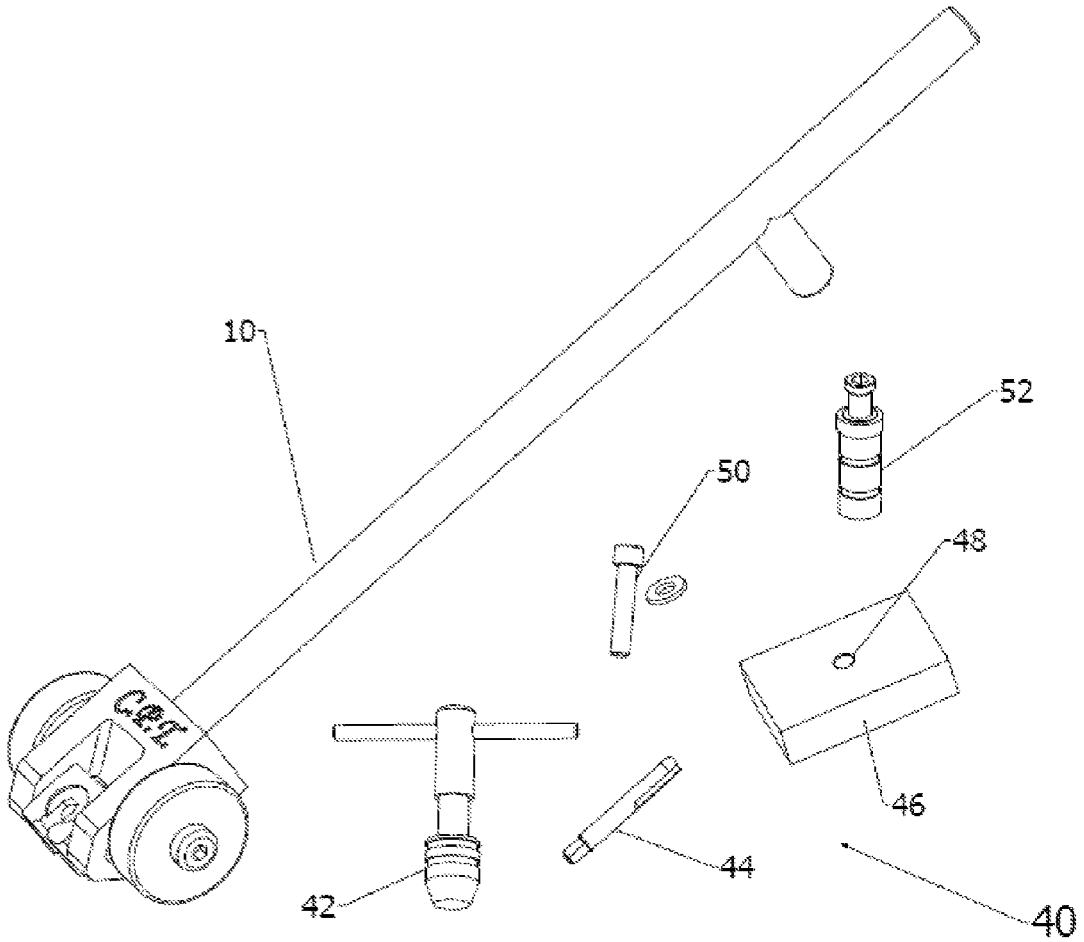
FIG. 6 is a top view of an embodiment of a kit for removing and replacing a pool or deck cover anchor.

As depicted in FIG. 6, an embodiment of a pool or deck cover anchor removal kit 40 may include an anchor removal tool 10, a tap handle 42, a threaded tap 44, and a tapping block 46. Embodiments of an anchor removal kit 40 may also include one or more threaded pry bolts 48 having a head and possibly also a washer, but a new pry bolt may be required for each anchor to be removed (because the pry bolt may be damaged or stuck to the old anchor after removal). The threads of the pry bolt should match the threads of the tap. Embodiments of a kit may also include a replacement anchor 52.

Embodiments of the present invention include a device and also a method for removing a pool or deck cover anchor and possibly replacing the anchor with a new one. The anchor may be a brass or other anchor sunk into the ground, such as a concrete walk or patio, and the anchor is adapted to hold the lines for a pool or deck cover. The anchor is to be removed, but due to design and/or weathering it cannot easily, simply be pulled or screwed out without special tools.

Embodiments of a method for removing a pool or deck cover anchor may include the following steps:

1. Provide an anchor removal tool, a hand-operated tap handle, a threaded tap for the handle, a tapping block having an alignment hole, and a pry bolt whose diameter and threads correspond with the diameter and threads of the tap. The anchor removal tool includes a base, a swivel on a front of the base with a U-shaped gripping element, and a handle on a rear of the base, so that the base, swivel, and handle forming a lever adapted to lift the anchor out of the ground. This may be provided in a kit that includes all elements, or the anchor removal tool and other components may be sold separately.

Figure 7:
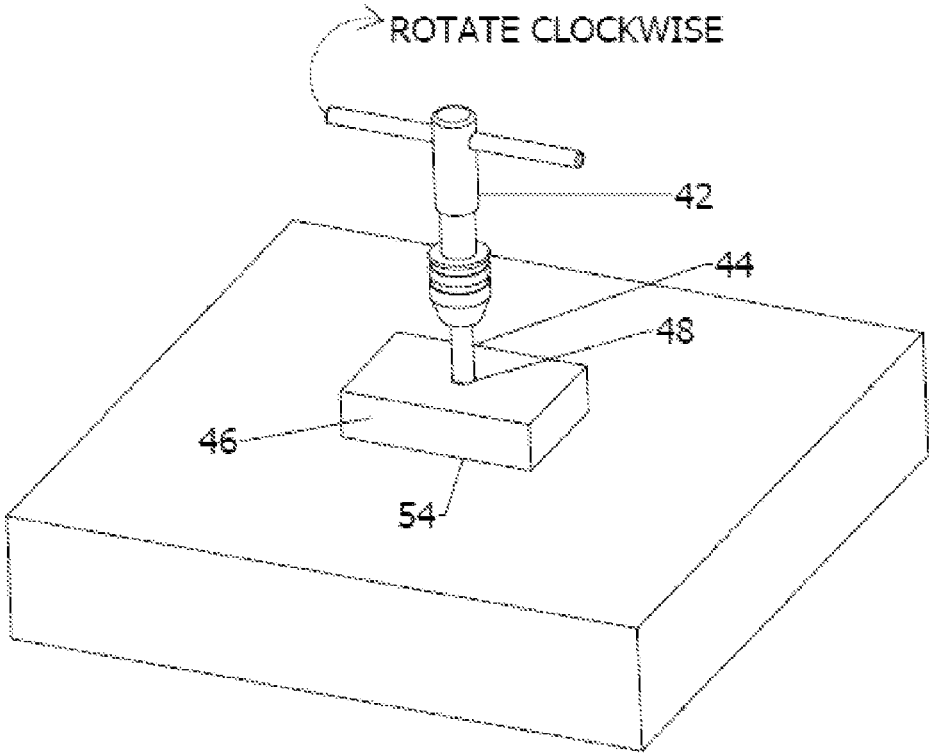
FIGS. 7-13 depict the steps in an embodiment of a method for removing a pool or deck cover anchor.

2. As depicted in FIG. 7, install the tap 44 into the tap handle 42, place the tapping block 46 over the old pool or deck anchor 54 so the alignment hole in the block aligns with the top of the anchor, run the end of the tap into the alignment hole, and then twist the tap handle clockwise so that the tap is driven into the anchor 54 thereby creating a threaded hole in the top of the anchor ("tapping the anchor").

Figure 8:
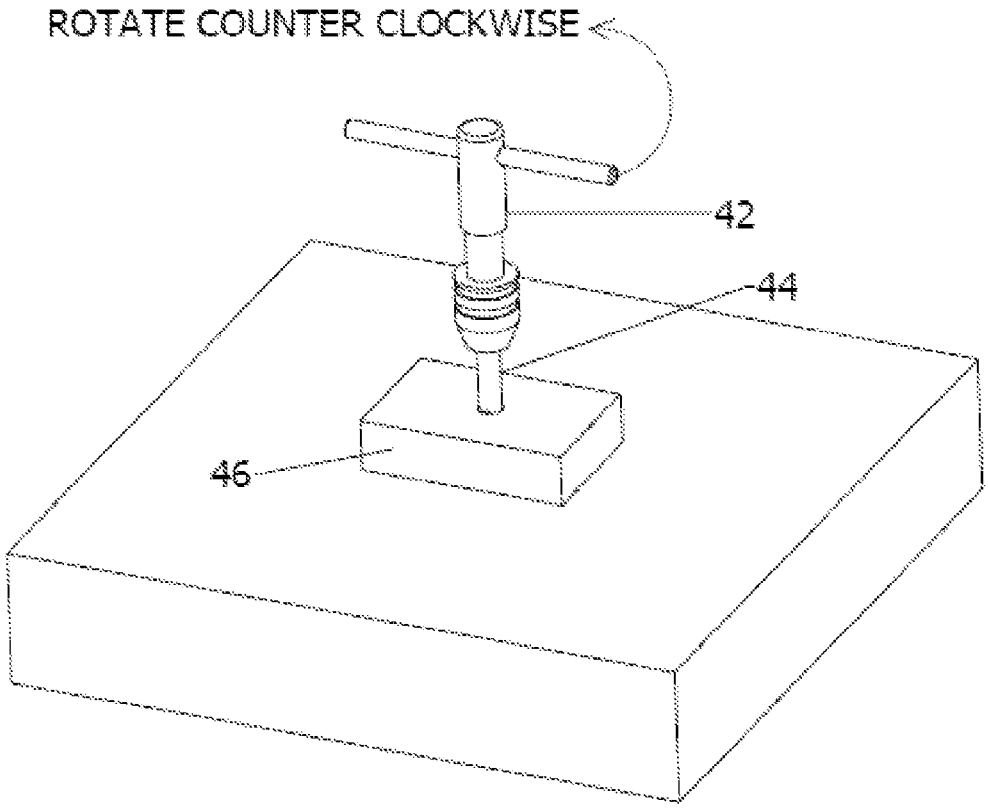

3. As depicted in FIG. 8, twist the tap handle 42 in the opposite direction (counter-clockwise) and remove the tap.

Figure 9:
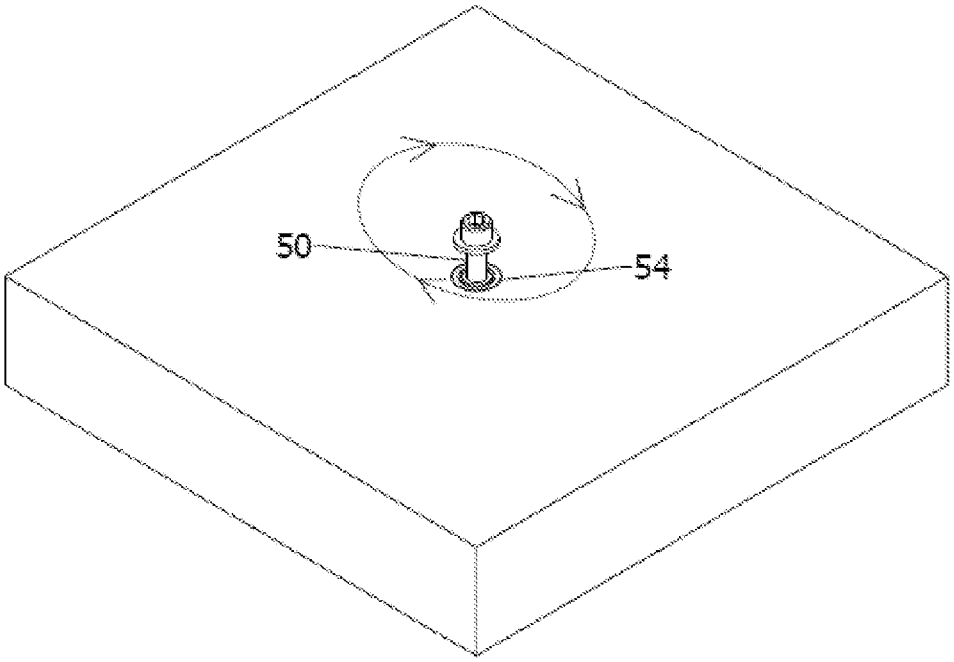
Figure 10:
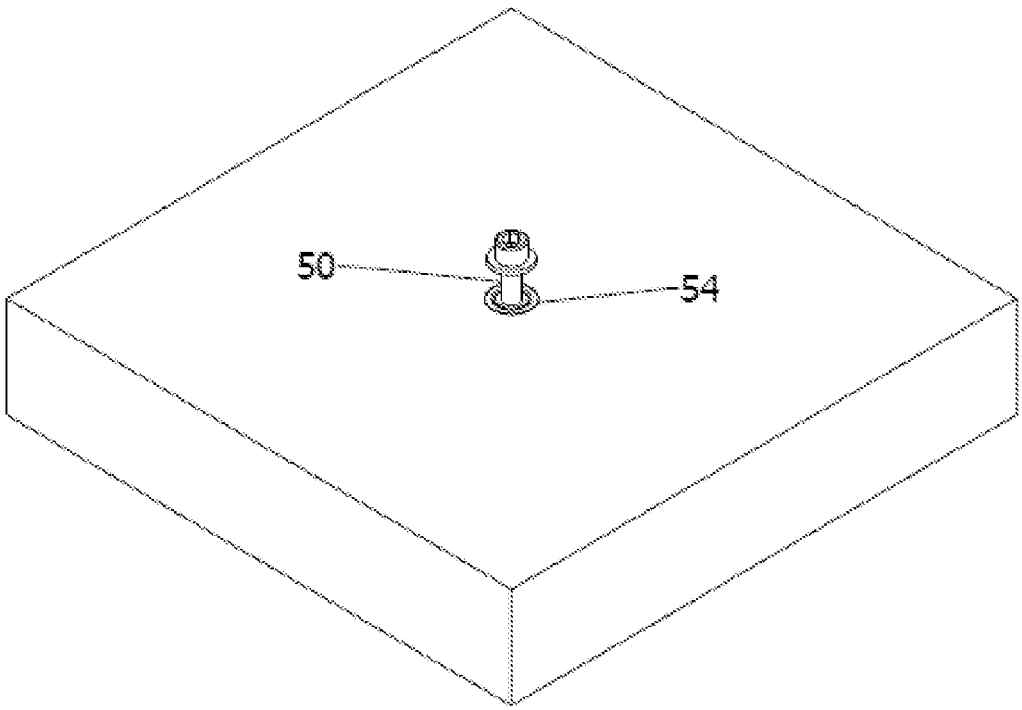

4. As depicted in FIG. 9, screw the pry bolt 50 into the newly created threaded hole in the top of the anchor. As depicted in FIG. 10, the pry bolt should have a strong, engaging fit, so that the bolt will strongly grip the anchor.

Figure 11:
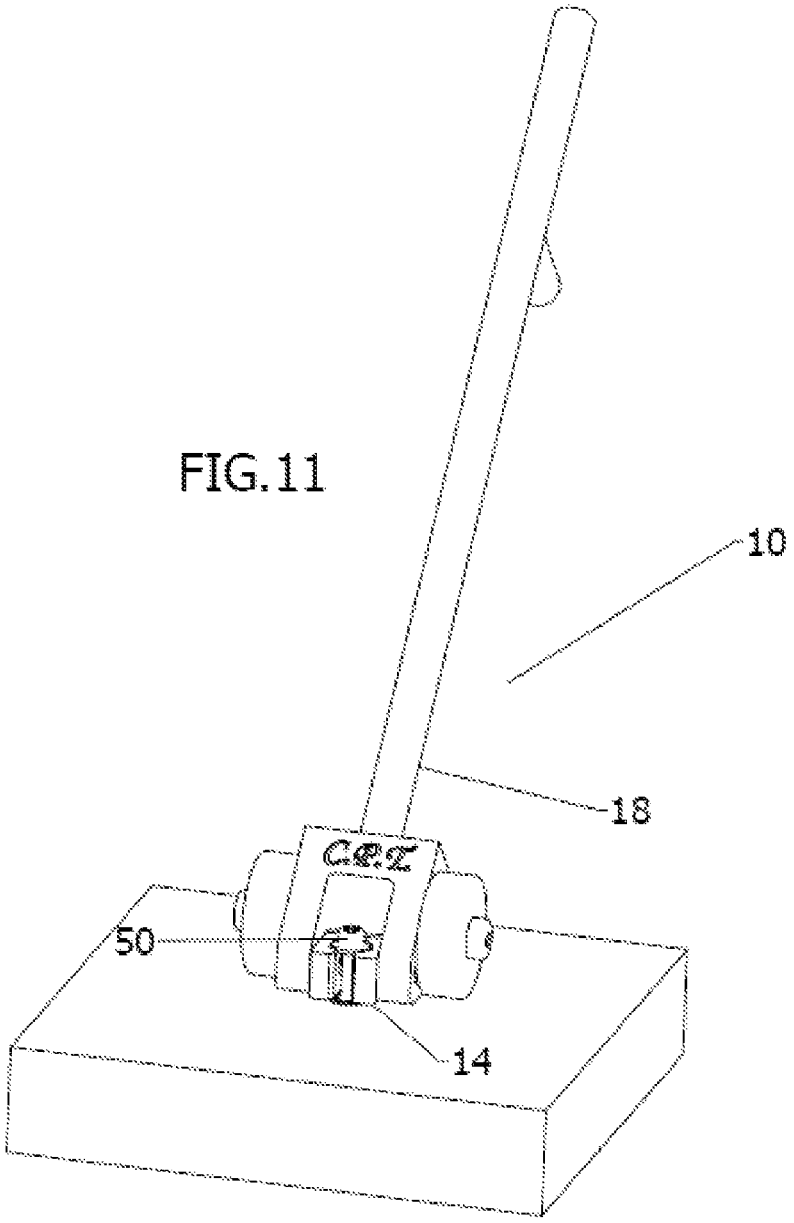

5. Use the anchor removal tool to lift the pry bolt, thereby removing the anchor. This includes the following sub-steps:

5A. As depicted in FIG. 11, lift the handle 18 of the anchor removal tool 10 and slide the swivel 14 against and around the shaft of the pry bolt 50 so that the top of the swivel 14 engages with the head or washer of the pry bolt 50. In embodiments, the anchor removal tool further includes wheels which can be used to help slide the swivel against the pry bolt.

Figure 12:
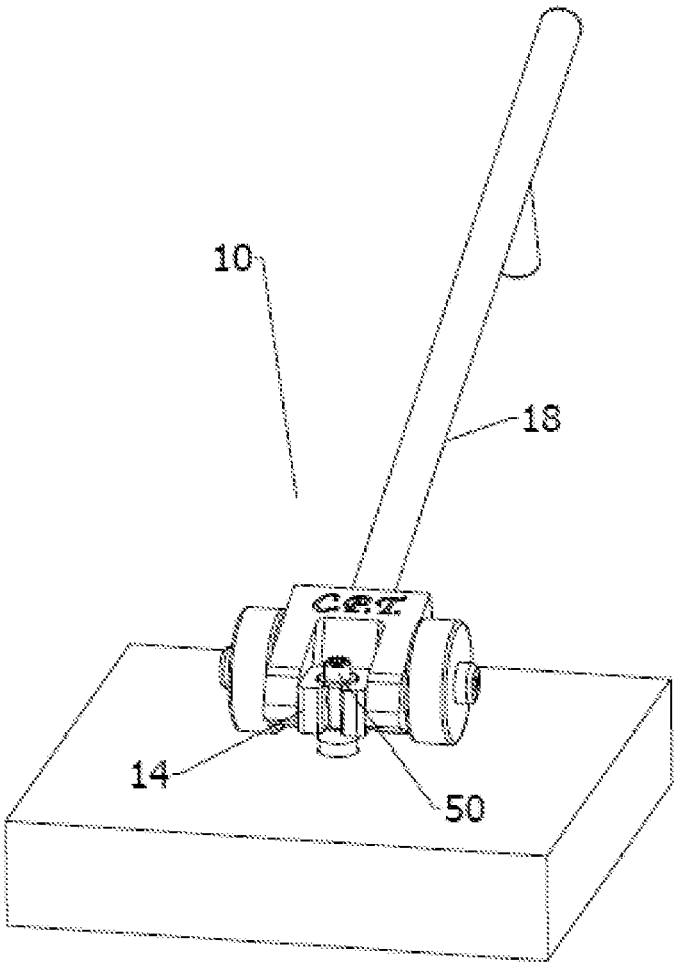

5B. As depicted in FIG. 12, lower the handle 18 so that anchor removal tool 10 forms a lever and the swivel 14 provides a lifting force against the pry bolt 50. The swivel 14 will rotate to stay level and provide a straight vertical lifting force. The handle naturally moves generally downward in an arc of a circle, but the swivel provides a vertical force that lifts the anchor straight up out of the ground. The anchor may slide or roll a slight distance so that the lifting force is straight vertical, thereby avoiding lateral forces on the anchor which may damage the concrete ground.

Figure 13:
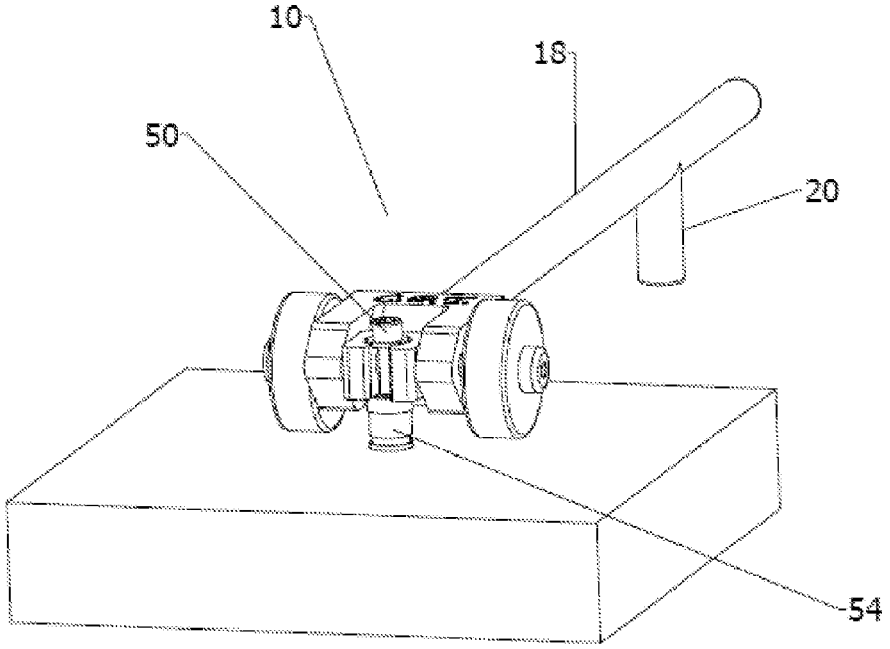

5C. As depicted in FIG. 13, lower the handle 18 until the handle stop 20 touches the ground. This will force the anchor 54 up and out, thereby removing the anchor 54, while preventing a distal end of the handle from touching the ground. Discard the old anchor 54. Either remove the pry bolt 50 from the used anchor 54 so the pry bolt 50 can be used again, or discard the pry bolt 50 along with the old anchor 54.

Figure 14:
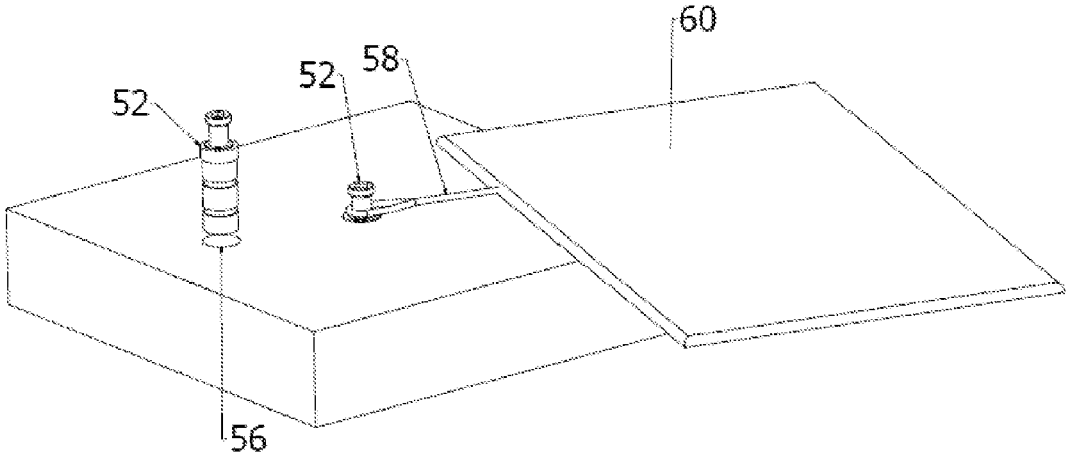
FIG. 14 depicts a step in an embodiment of a method for removing and replacing a pool or deck cover anchor.

6. As depicted in FIG. 14, in an optional embodiment, an installer may further provide a replacement pool or deck cover anchor 52 and hammer or screw the new anchor 52 into the hole 56 left by the removed anchor, thereby replacing the anchor. The new anchor 52 may then be used to retain a line 58 that holds a deck or pool cover 60.

Embodiments of a pool or deck anchor may be brass. The anchor may have a socket at the top end to receive a screw or wrench, such as a hex hole for an Allen wrench. The anchor may be inserted into the ground so that the socket is flush with the concrete and the anchor is not in the way. Some anchors screw out above the concrete so the anchor can be removed, to hold a pool cover in place for the winter. Other screws are not easily moved or screwed out, so one may have to manually remove the anchor in order to replace it. One may use a 5/16 tap and tap the hex hole that is in the brass screw. Then screw a 5/16 bolt with a washer into the brass screw. The swivel may be slid onto an anchor, particularly the bolt and washer. A user may then push down on the handle and the anchor may start to come out of the ground. During this process, the wheels may roll underneath the anchor to lift the anchor straight up and out of the ground or concrete. When the handle stop touches the concrete, the anchor may be completely removed.

An embodiment of an anchor removal device includes a base having a front end and a rear end; a U-shaped swivel configured to receive an anchor, and attached to the front end of the base; and a handle attached to the rear end of the base.

I claim:

1. A device for use with an anchor set in the ground, the device comprising:

a base having a front and a rear;

a swivel rotatably attached to the front of the base, the swivel having a gripping element adapted to grip the anchor;

a handle attached to the rear of the base;

a tap handle;

a threaded tap;

a tapping block having an alignment hole; and a pry bolt having threads that correspond with threads of the tap;

wherein the handle, base, and swivel form a lever so that a generally downward force on the handle produces a straight vertical force on the anchor that lifts the anchor out of the ground.

2. The device of claim 1, wherein the anchor is a deck or pool cover anchor adapted to attach to lines that hold the cover in place.

3. The device of claim 1, further comprising two wheels attached to sides of the base with shoulder bolts.

4. The device of claim 1, wherein the swivel is rotatably attached to the front of the base with dowel pins so that the swivel is free rotate, thereby providing a gripping element that will stay level and provide a straight vertical lifting force.

5. The device of claim 1, wherein the gripping element of the swivel is U-shaped.

6. The device of claim 1, further comprising a handle stop on the handle.

7. The device of claim 1, further comprising a tube removably attached to the handle with a screw that passes through a bore of the tube, thereby providing a handle stop.

8. The device of claim 1, further comprising a receiving cavity in the base that retains the handle.

9. The device of claim 1, wherein the handle is substantially longer than the swivel, thereby providing a substantial mechanical leverage.

10. A deck or pool cover anchor removal tool comprising:

a base having a front, a rear, and two sides;

a swivel rotatably attached to the front of the base with dowel pins so that the swivel will rotate to stay level;

a U-shaped gripping element on the swivel, adapted to grip the anchor;

a handle attached to the rear of the base, the handle being substantially longer than the swivel;

a handle stop on the handle; and wheels rotatably attached to the sides of the base;

wherein the handle, base, and swivel form a lever and the wheels allow the tool to roll so that a generally downward force on the handle produces a straight vertical force on the anchor that lifts the anchor out of the ground.

11. The device of claim 1, further comprising:

a replacement device, thereby further providing a kit for replacing the anchor.

12. The device of claim 10, further comprising:

a replacement device, thereby further providing a kit for removing and replacing the anchor.

* * * * *